US006370986B1

(12) United States Patent
Scott

(10) Patent No.: US 6,370,986 B1
(45) Date of Patent: Apr. 16, 2002

(54) IMPACT CUSHIONING TOOL HANDLE

(75) Inventor: Gary Scott, Sheffield (GB)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/533,735

(22) Filed: Mar. 23, 2000

Related U.S. Application Data

(60) Provisional application No. 60/126,256, filed on Mar. 25, 1999.

(51) Int. Cl.[7] ..... B25D 1/00
(52) U.S. Cl. ..... 81/22; 81/21; 81/28; 29/428
(58) Field of Search ..... 81/22, 21, 28; 29/428

(56) References Cited

U.S. PATENT DOCUMENTS

| | | | | |
|---|---|---|---|---|
| 2,754,863 | A | * | 7/1956 | Yearley |
| 2,960,133 | A | | 11/1960 | Shepherd, Jr. ..... 145/61 |
| 2,983,296 | A | | 5/1961 | Lay ..... 145/29 |
| 4,166,488 | A | * | 9/1979 | Irby |
| 4,738,166 | A | | 4/1988 | Yamaguchi ..... 81/22 |
| 5,280,739 | A | | 1/1994 | Liou ..... 81/22 |
| 5,299,475 | A | | 4/1994 | Stroop ..... 81/489 |
| 5,443,378 | A | | 8/1995 | Jaroschek et al. ..... 425/130 |
| 5,588,343 | A | | 12/1996 | Rust et al. ..... 81/489 |
| 5,601,003 | A | * | 2/1997 | Amtenbrink et al. |
| 5,657,674 | A | * | 8/1997 | Burnett |
| 5,704,259 | A | * | 1/1998 | Riehle |

* cited by examiner

*Primary Examiner*—Timothy V. Eley
*Assistant Examiner*—Willie Berry, Jr.
(74) *Attorney, Agent, or Firm*—Pillsbury Winthrop LLP

(57) ABSTRACT

A manually operable impact tool that includes an elongated rigid interior handle structure extending longitudinally with respect to the tool, an impact head disposed at one longitudinal end portion of the handle structure and an exterior impact cushioning gripping structure affixed to a second longitudinal end portion of the elongated interior handle structure in surrounding relation thereto. The exterior impact cushioning gripping structure is formed of inner and outer layers of molded material. The inner layer is a foamed material that is selected from a group consisting of polyvinyl chloride, polypropylene, and thermoplastic elastomer and is molded in surrounding relation to the elongated interior handle structure. The outer layer is constructed of a solid nonfoamed material that is chemically compatible with the inner layer and is molded in surrounding abutting relation to the inner layer. The chemically compatible material used to form the outer layer is chosen from the same group of materials that is used to form the inner layer, viz., polyvinyl chloride, polypropylene, and thermoplastic elastomer. The outer layer is constructed and arranged to provide an inner surface on the outer layer that chemically compatibly bonds to an outside surface of the inner layer and to provide an exterior surface on the outer layer configured to accommodate a manually gripping hand. The arrangement of the gripping structure is such that when it is gripped by a user and the tool is manually operated to impact the tool head on a work piece, the inner layer of foamed material cushions the impact to the gripping hand of the user.

6 Claims, 3 Drawing Sheets

IMPACT CUSHIONING TOOL HANDLE

The present application claims priority to U.S. Provisional Application of Scott, filed Mar. 25, 1999, Ser. No. 60/126,256, the entirety of which is hereby incorporated into the present application by reference.

FIELD OF THE INVENTION

The present invention relates to handles for hand tools and more particularly relates to an impact cushioning, molded plastic handle grip that reduces the impact transferred to the hand of a user when the hand tool impacts a work piece.

BACKGROUND OF THE INVENTION

Many tool handles, such as hammer handles, are constructed of a metal, a synthetic or a composite material. Steel and fiberglass, for example, are often used for tool handle construction. These materials offer reduced materials cost, uniformity of structure and the ability to securely and permanently affix the hammer head or other tool head to the handle. Metal, synthetic and composite handles are relatively durable as compared to wooden handles. Metal, synthetic and composite handles have some disadvantages, however. These handles tend to transfer an undesirable degree of kinetic energy to a user's hand when a work piece is impacted. Many hammers with metal or synthetic handles are provided with rubber or rubber-like sleeves at the free end opposite the hammer head to provide a degree of impact protection for the hand of the user. Most of these sleeves are constructed of a relatively hard, non-cushioned single material, however, and provide insufficient protection. A need exists for an impact tool grip that can be used on metal, composite and synthetic handles that provides a high degree of cushioning to protect the hand from the kinetic energy transferred thereto during impact and that can be applied to these handles easily during the manufacturing process.

SUMMARY OF THE INVENTION

It is an object of the present invention to meet the need expressed above by providing a manually operable impact tool that includes an elongated rigid interior handle structure extending longitudinally with respect to the tool, an impact head disposed at one longitudinal end portion of the handle structure and an exterior impact cushioning gripping structure affixed to a second longitudinal end portion of the elongated interior handle structure in surrounding relation thereto. The exterior impact cushioning gripping structure is formed of inner and outer layers of molded material. The inner layer is a foamed material that is selected from a group consisting of polyvinyl chloride, polypropylene, and thermoplastic elastomer and is molded in surrounding relation to the elongated interior handle structure. The outer layer is constructed of a solid nonfoamed material that is chemically compatible with the inner layer and is molded in surrounding abutting relation to the inner layer. The chemically compatible material used to form the outer layer is chosen from the same group of materials that is used to form the inner layer, viz., polyvinyl chloride, polypropylene, and thermoplastic elastomer. The outer layer is constructed and arranged to provide an inner surface on the outer layer that chemically compatibly bonds to an outside surface of the inner layer and to provide an exterior surface on the outer layer configured to accommodate a manually gripping hand. The arrangement of the gripping structure is such that when it is gripped by a user and the tool is manually operated to impact the tool head on a work piece, the inner layer of foamed material cushions the impact to the gripping hand of the user.

Preferably, the inner layer is molded to provide a plurality of longitudinally extending, circumferentially spaced grooves on the outside surface thereof and the outer layer is molded to provide a plurality of integral inwardly extending ribs on the inner surface thereof that extend within the grooves and that are compatibly chemically bonded therein. The ribs are constructed and arranged so that when a hand grips the exterior impact cushioning gripping structure, the ribs lend rigidity to the gripping load and provide a measure of control of the compression of the foamed inner layer against the handle structure.

The exterior impact cushioning gripping structure can be used on the handles of a wide range of manually operable impact tools including carpenter's hammers, axes, sledge hammers, pick axes, hatchets and ball peen hammers. The exterior impact cushioning gripping structure can be used, for example, on a hammer that includes an interior handle structure configured to dampen the vibrations that occur in the handle structure when the impact head impacts a work piece. More specifically, the second end portion of the handle structure may include a pair of vibration receiving elements extending longitudinally away from the one longitudinal first end portion and terminating in spaced relation to one another. The vibration receiving elements define a space therebetween and the inner layer of foamed material is formed around the second end portion so that a portion of the inner layer is received within the space and surrounds the vibration receiving elements. Vibrations resulting when the impacting head impacts a work piece are received by the vibration receiving elements and are damped by cooperation between the elements and the inner layer of material to thereby reduce the vibrations that are transmitted to the hand of the user when the impact tool impacts a work piece.

DETAILED DESCRIPTION OF THE PREFERRED EMBODIMENT AND BEST MODE OF THE INVENTION

Figure 1:
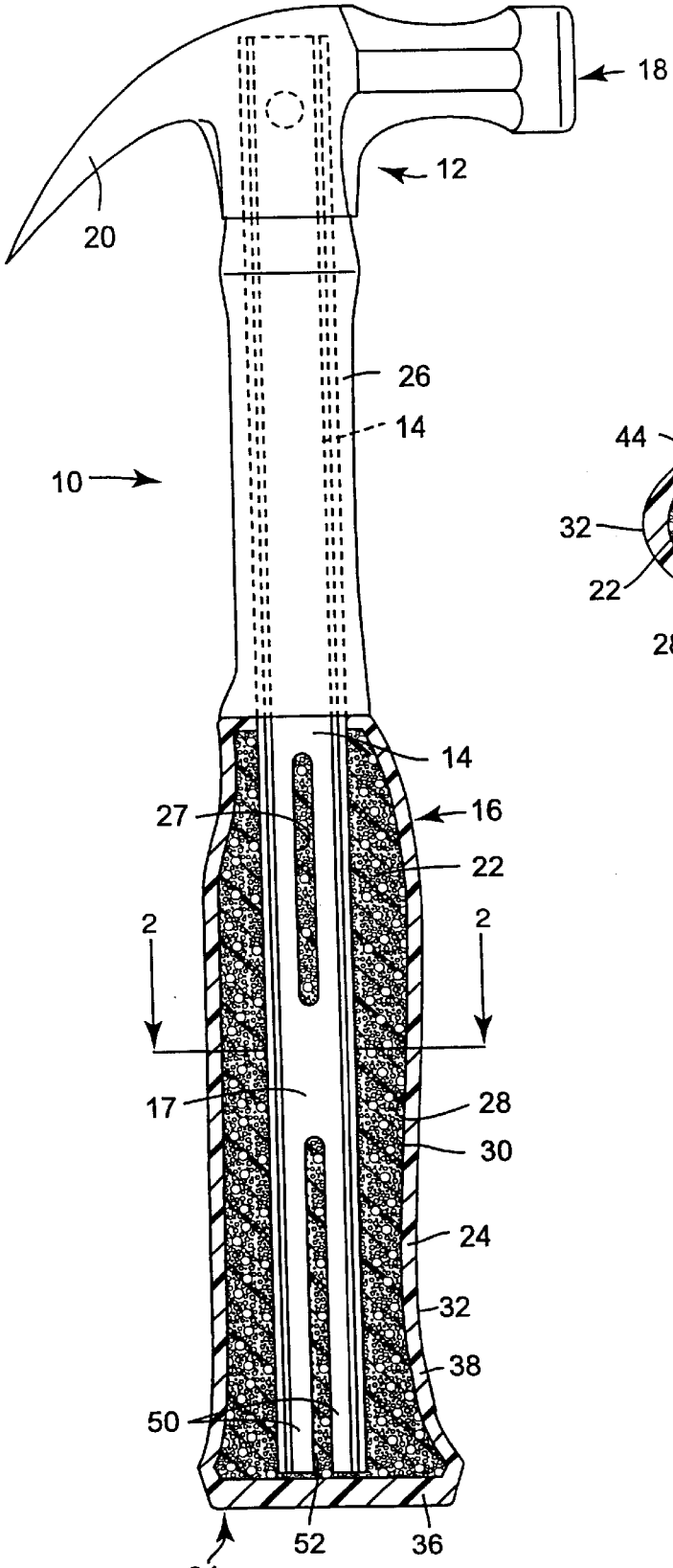
FIG. 1 is a cross-sectional view of an impact tool.

FIG. 1 is a cross-sectional view of a manually operable impact tool, generally designated 10, constructed according to the principles of the present invention. The impact tool shown is a carpenter's or "claw" hammer, but this is exemplary only and not intended to be limiting. It is within the scope of the invention to apply the principles of the invention to any type of hand tool used to manually impact a work piece.

The manually operable impact tool 10 includes an impact head 12 (which is not cross sectioned in FIG. 1 to more clearly illustrate the invention), an elongated rigid interior handle structure 14 extending longitudinally with respect to the manually operable impact tool 10 and an exterior impact-cushioning gripping structure 16 affixed to a second end portion 17 of the interior handle structure 14 in surrounding relation thereto.

The impact head 12 for the hammer shown is of conventional construction and is preferably made of steel or other appropriate metal. The impact head 12 includes a striking surface 18 and a pair of nail removing claws 20.

The interior handle structure 14 is a rigid structural member that supports the impact head 12. The preferred interior handle structure 14 shown in FIG. 1 is an I-beam structure having a vibration reducing "tuning fork" portion toward the handle end thereof as disclosed fully in U.S. Provisional Patent Application, Ser. No. 60/096,688, filed Aug. 14 1998, which is hereby incorporated by reference in its entirety. While it has been found that the anti-vibration characteristics of the impact-cushioning gripping structure are particularly effective when used with the aforementioned preferred interior handle structure 14, the cushioning gripping structure of the present invention is beneficial to other types of handle structures as well. Thus, the present invention contemplates that virtually any known interior handle structure may be used.

Figure 2:
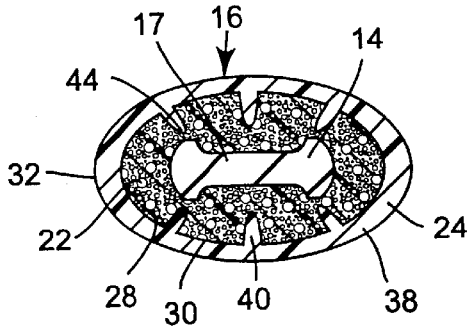
FIG. 2 is a cross-sectional view of the impact tool taken through the line 2—2 in FIG. 1.

The interior handle structure 14 shown in FIGS. 1–2 is preferably made of steel, but any interior handle constructed of a metal, composite or synthetic material can be used in the hammer construction. The impact head 12 can be affixed to the interior handle structure 14 in any conventional manner. The details of the structure of the impact head 12 and the structure of the interior handle structure 14 and the manner in which the impact head 12 is rigidly mounted on the first end portion of the interior handle structure 14 are fully disclosed in U.S. Provisional Patent Application Ser. No. 60/096,688 filed Aug. 14, 1998 as aforesaid.

The focus of the present invention is the structure of the exterior gripping structure 16 and the manner in which it is formed on the interior handle structure 14. FIGS. 1–2 show in sectional view the exterior gripping structure 16 affixed to an outer end portion 17 of the interior handle structure 14. The exterior gripping structure 16 is comprised of an inner layer 22 of foamed material molded in surrounding relation to the outer end portion 17 of the interior handle structure 14 and an outer layer 24 of solid, non-foamed material molded in surrounding abutting relation to the inner layer 22. The foamed material of the inner layer is selected from a group consisting essentially of polyvinyl chloride (PVC), thermoplastic elastomer (TPE), and polypropylene. The outer layer 24 is relatively harder in comparison with the inner layer 22 yet may still be flexible or resilient. The outer layer 24 is also selected from the group consisting essentially of PVC, TPE, and polypropylene. These materials for the inner and outer layers 22, 24 are chosen to be chemically compatible to facilitate bonding of the two layers during the molding process and prevent delamination between layers of the final product. For example, in the most preferred embodiment, the inner layer comprises a foamed PVC material, while the outer layer comprises a non-foamed solid PVC material. Because the inner layer is foamed and the outer layer is not foamed, the inner layer is softer relative to the outer layer. In another preferred embodiment, the inner layer comprises a foamed TPE material, and the outer layer comprises a non-foamed, solid polypropylene material. In yet another preferred embodiment, the inner layer comprises a foamed TPE material, and the outer layer 24 comprises a non-foamed, solid TPE material.

Preferably, the exterior impact-cushioning gripping structure 16 is formed on the outer end portion 17 of the interior handle structure 14 through a two part molding process (sometimes also referred to as "two shot" or "double shot" molding). During tool construction, the impact head 12 and a rigid material 26 are secured to the interior handle structure 14 as described in the above incorporated provisional patent application reference. The rigid material 26 is preferably a thermoplastic polyurethane. The exterior impact-cushioning gripping structure 16 is then molded onto the impact tool 10 to complete the construction of the tool.

In the first part of the two part molding process, the outer end portion 17 of the interior handle structure 14 is placed in a first mold cavity and a foamed or gas-filled polyvinyl chloride is injected into the cavity to completely fill the mold. Foamed polyvinyl chloride is widely commercially available and is sometimes referred to as a "blown", "self-blown" or "self-skinning" polyvinyl chloride. The foamed polyvinyl chloride forms a honeycomb-like cushioning structure that constitutes the inner layer 22 around the interior handle structure 14.

Preferably the polyvinyl chloride or other material of the inner layer 22 is relatively soft compared to the harder outer layer of material and has a Shore A Durometer of from about 45 to about 65, the preferred Durometer being 55. Because the first mold cavity is completely filled with the foamed material, the size of the cavity determines the size and shape of the inner layer 22. Preferably one or more holes 27 are provided in the outer end portion 17 of the interior handle structure 14 through which the foamed material can flow as the mold is being filled during the molding process to help secure the inner layer 22 to the interior handle structure 14.

The tool 10 is removed from the first mold and placed in a second mold in which the second part of the molding process occurs. The tool 10 can be transferred from the first mold to the second mold manually by a machine operator or automatically by an appropriate device on the molding machine. A relatively harder polyvinyl chloride (relative to the inner layer 22) having a Shore A Durometer of from about 66 to about 76, with the preferred Durometer being 71, is injected into the second mold and completely fills the cavity of the second mold. The outer layer is molded to form an inner surface 28 on the outer layer 24 that chemically compatibly bonds to an outside surface 30 of the inner layer 22. The outer layer 24 is also molded to provide an exterior surface 32 on the outer layer that is configured to accommodate a manually gripping hand of a tool user.

One skilled in the art will appreciate that the exterior impact-cushioning gripping structure 16 can be formed on the interior handle structure 14 using well known, conventional molding processes on a conventional two part or "two shot" molding machine. Two part molding is advantageous in forming the two layers 22, 24 of the exterior impact-cushioning gripping structure 16 because this process allows the dimensions of the inner layer and the thickness of the walls of the outer layer 24 to be precisely controlled during manufacturing. It is desirable to have different wall thicknesses at different parts of the gripping structure 16 because the butt end 34 of the gripping structure 16 is frequently subjected to repeated impacts and so it is preferred to make the bottom wall 36 of the gripping structure 16 thicker than the side walls 38. It is preferable to make the side walls 38 relatively thin to improve the feel of the gripping structure and to provide improved impact cushioning.

The relatively soft foamed inner layer 22 provides most of the impact cushioning when a work piece is struck. It is preferable to provide a plurality of rib or fin-like structures 40 around the gripping structure 16 as shown in FIG. 2 to increase the firmness of and to rigidify of the gripping structure 16. As shown in FIG. 2, when the ribs 40 are provided, the inner layer 22 is preferably molded to provide a plurality of longitudinally and radially inwardly extending and circumferentially spaced grooves 44 on the outside surface 30 thereof during the first part of the molding process. When the tool 10 is transferred to the second mold, the material that will form the outer layer 24 flows into the grooves 44 as the second mold cavity is filled to provide the plurality of integral, inwardly extending ribs 40 on the inner surface 28 of the outer layer 24 that extend longitudinally the length of the gripped area of the gripping structure when the material of the outer layer 24 solidifies. The ribs 40 therefore extend within the grooves 44 and are compatibly chemically bonded therein during the molding process so that when a hand grips the exterior impact cushioning gripping structure, the ribs 40 lend rigidity to the gripping load and provide a measure of control over the compression of the foamed inner layer 22 against the interior handle structure 14.

When a user strikes a work piece with the tool 10, the user grips the gripping structure 16 and manually swings the tool 10 to impact the striking surface 18 on the work piece. When the impact head 12 hits the work piece, a portion of the kinetic energy of the impact is transferred through the interior handle structure 14 back to the user's hand. Metal, synthetic and composite impact tool handles tend to transfer a high degree of impact force to a user's hand when the tool impacts an object such as a nail or a chisel. Repeated exposure to the kinetic energy associated with tool impact frequently causes discomfort and pain in the user's hand. The foamed inner layer 22 of the exterior impact-cushioning gripping structure 16 cushions the impact and increases user comfort. The foamed layer 22 also dampens the vibrations that occur in the interior handle structure 14 following the impact of the impact head 12 on the work piece.

In the embodiment of the hammer shown in FIGS. 1–2, the exterior impact-cushioning gripping structure 16 is mounted on an interior handle structure 14 that includes a pair of vibration receiving elements 50 that extend longitudinally away from the end portion of the interior handle structure 14 to which the impact head 12 is secured and terminate in spaced relation to one another. The vibration receiving elements 50 define a space 52 therebetween and the inner layer 22 of foamed material is formed around the outer end portion 17 of the interior handle structure 14 so that a portion of the inner layer 22 is received within the space 52 and surrounds the vibration receiving elements 50. The vibrations resulting when the impacting head 12 impacts a work piece are received by the vibration receiving elements and are damped by cooperation between the elements 50 and the inner layer 22 of material to thereby reduce the vibrations that are transmitted to the hand of the user when said impact tool 10 impacts a work piece.

The details of the structure and operation of the interior handle structure 14 are described in the incorporated patent application reference and will not be repeated herein. Applying an exterior impact-cushioning gripping structure 16 constructed according to the principles of the present invention improves the vibration dampening performance of the plurality of embodiments of the interior handle structure disclosed in the incorporated application and it is within the scope of the present invention provide any of the handle structures in the referenced application with a gripping structure constructed in accordance with the teachings of the present application.

Figure 5:
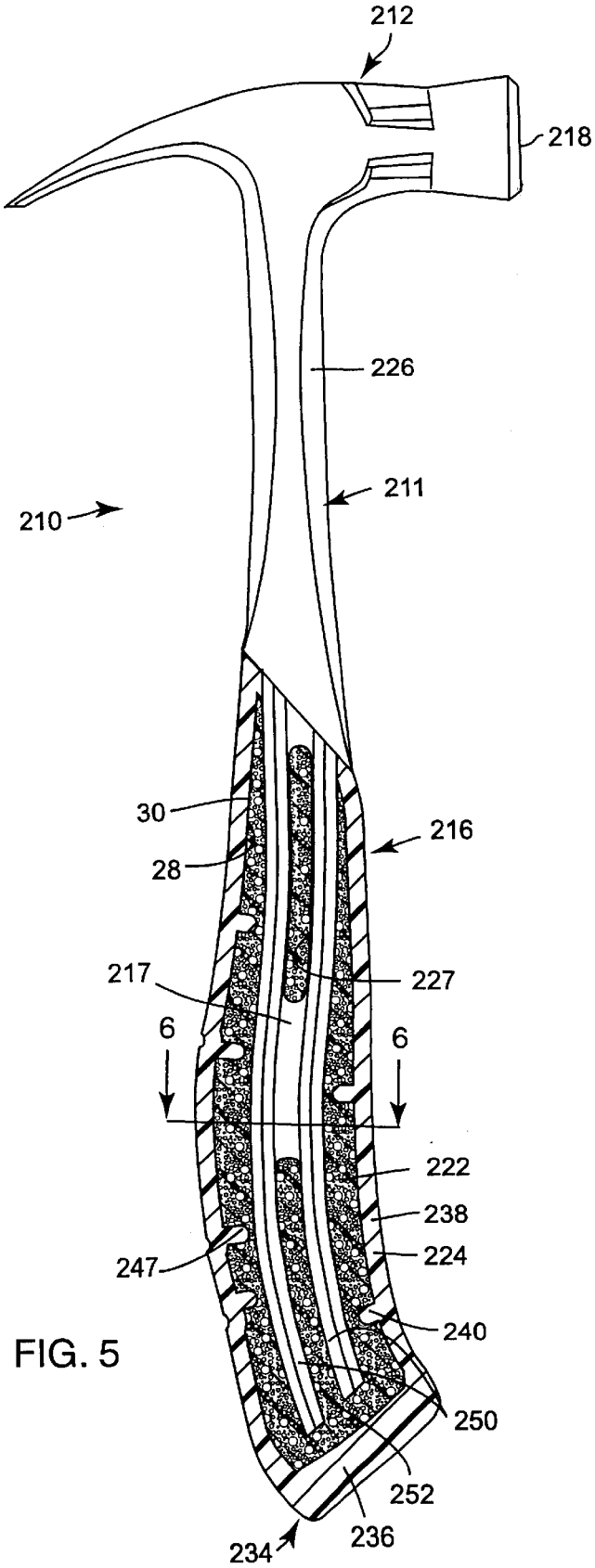
FIG. 5 is a cross-sectional view of a third embodiment of the impact tool.

The interior handle structure 14 of the manually operable impact tool 10 is essentially straight from one longitudinal end to the opposite end. It is also within the scope of the present invention to provide an impact-cushioning gripping structure on an interior handle structure that is curved or shaped to conform to the contours of a gripping hand. Two representative interior handle structures that each include a pair of vibration receiving elements and that are shaped to conform to a gripping hand are shown in FIGS. 3 and 5.

Figure 3:
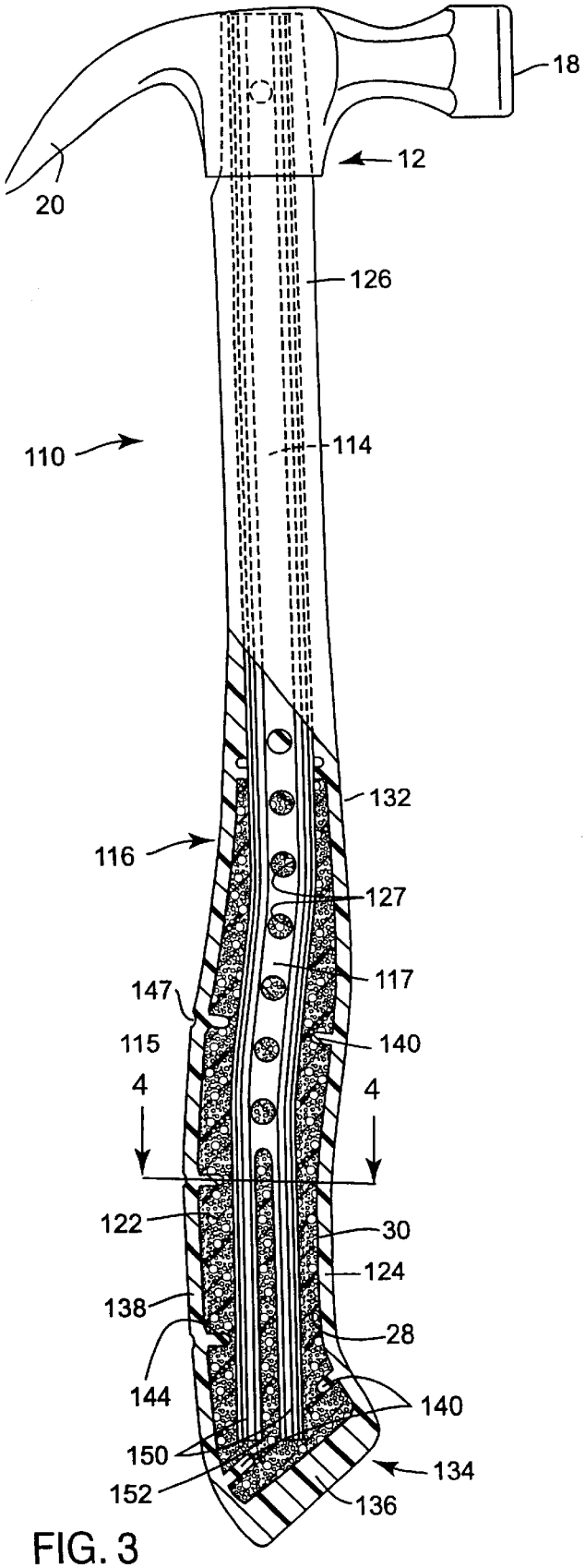
FIG. 3 is a cross-sectional view of a second embodiment of the impact tool.

FIG. 3 shows a cross-sectional view of a second embodiment of the manually operable impact tool, generally designated 110. Structures on the manually operable impact tool 110 that are identical to structures on the manually operable impact tool 10 are designated by identical reference numerals and are not further described. The rigid material 126 and the impact head 12 are rigidly secured to an interior handle structure 114 in the same manner in which the rigid material 26 and impact head 12 are secured to the interior handle structure 14 of the manually operable impact tool 10.

An arcuate central portion 115 of the outer end portion 117 curves rearwardly (relative to the striking surface 18 which is considered to be facing in the forward direction of the manually operable impact tool) to fit comfortably within the palm of a gripping hand of a tool user using the tool to impact a work piece. The outer end portion 117 includes a tuning fork structure that functions and that is constructed according to the principles taught in the 60/096,688 provisional application reference. More specifically, pair of vibration receiving elements 150 extend longitudinally away from the longitudinal end portion of the interior handle structure 114 to which the impact head 12 is secured defining a space 152 therebetween. The vibration receiving elements 150 are essentially straight and parallel and function to damped vibration in the same manner as the vibration receiving elements 50 of the manually operable impact tool 10. A series of cylindrical apertures 127 are provided in the lower end portion 117 of the interior handle structure 114.

An exterior impact-cushioning gripping structure 116 is provided in surrounding relation to the end portion 117 of the interior handle structure 114 and is of similar construction to the exterior impact-cushioning gripping structure 16 of the manually operable impact tool 10. The exterior impact-cushioning gripping structure 116 can be constructed of any of the materials used to construct the exterior impact-cushioning gripping structure 16 and is formed by an identical two part molding process. The relatively soft foamed inner layer 122 of the exterior impact-cushioning gripping structure 116 is formed around the end portion 117 of the interior handle structure 114 and extends through the space 152 to surround both elements 150 and through the apertures 127.

A plurality of ribs 140 integrally formed with the outer layer 124 of relatively hard material are formed within transversely extending grooves 144 formed in the inner layer 122 during the first molding step. The structure of a rib 140 is shown in the cross-sectional view of the manually operable impact tool 110 shown in FIG. 4. The ribs 140 of the manually operable impact tool 110 serve a function similar to the ribs 40 of the manually operable impact tool 10.

The bottom wall 136 of the outer layer 124 at the butt end 134 of the manually operable impact tool 110 is preferably molded to be thicker than the side walls 138 thereof for the same reason the wall 36 is made thicker than walls 38 of the manually operable impact tool 10, i.e., the butt end 134 may be subjected to repeated impacts. A series of exterior grooves 147 (best seen in the cross-sectional view of FIG. 4) are provided on the exterior surface 132 of the exterior impact-cushioning gripping structure 116 to facilitate the gripping engagement of the same with the hand of a tool user.

Figure 6:
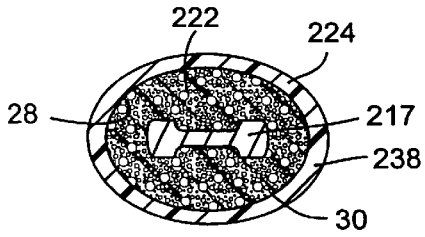
FIG. 6 is a cross-sectional view of the impact tool of FIG. 5 taken through the line 6—6 of FIG. 5.

The preferred embodiment and best mode of the manually operable impact tool, generally designated 210, is shown in FIGS. 5–6 that includes a single piece forged vibration damping tool member 211 and an exterior impact-cushioning gripping structure 216 molded about a lower portion thereof. The tool member 211 is an integral structure made of a forged (or alternatively of a die cast) piece of metal, the preferred metal being a high strength steel. The tool member 211 includes an impact head portion 212, a upper shaft portion 226 and a lower vibration damping shaft portion 217. The upper and lower shaft portions 226, 217 comprise an interior handle structure 214 of the manually operable impact tool 210.

The lower shaft portion 217 includes a tuning fork structure constructed according to the principles taught in the 60/096,688 provisional application reference. A pair of arcuate vibration receiving elements 250 extend longitudinally away from the end portion of the interior handle structure 214 at which the impact head 212 is integrally formed and define a space 252 therebetween that receives the inner layer 222 of the relatively soft foamed material during the two part molding process that forms the exterior impact-cushioning gripping structure 216. An elongated aperture 227 is provided in a central portion of the lower shaft portion 217 to facilitate attachment of the molded exterior impact-cushioning gripping structure 216.

Figure 4:
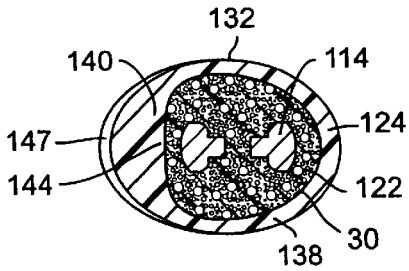
FIG. 4 is a cross-sectional view of the impact tool of FIG. 3 taken through the line 4—4 of FIG. 3.

It can be appreciated that the structure of the exterior impact-cushioning gripping structure 216 are similar to that of the exterior impact-cushioning gripping structure 116 shown in FIGS. 3–4 and includes similarly constructed ribs 240, a thick bottom wall 236 of outer layer 224 material at the butt end 234 that is thicker than the side walls 238 of the outer layer 224 and exterior, grip enhancing grooves 247.

It can be appreciated that the inner layer 222 and outer layer 224 of the exterior impact-cushioning gripping structure 216 is of the same general construction as the exterior impact-cushioning gripping structure 16 of the manually operable impact tool 10 and is formed by an identical two part molding process. The same materials can be used to construct the exterior impact-cushioning gripping structure 216 as are used to construct the exterior impact-cushioning gripping structure 16, the preferred material for the exterior impact-cushioning gripping structure 216 being polyvinyl chloride having a Shore A Durometer of 55 for the inner layer 222 and a Shore A Durometer of 71 for the outer layer 224. The same ranges of hardness for the layers 222, 224 recited above for the exterior impact-cushioning gripping structure 216 are applicable for the exterior impact-cushioning gripping structure 16.

It is understood that it is also within the scope of the present invention to provide two layer exterior impact-cushioning gripping structures on a wide variety of impact tools including all types of hammers, axes, picks, and hatchets. Furthermore it is understood that many molding methods can be used to provide an impact cushioning grip structure without departing from the broad teachings of the invention. These molding methods include transfer molding and monosandwich molding. These and other methods are effective in molding an impact cushioning and vibration dampening grip structure on a wide range of handles on a wide range of impact tools, but are not the preferred methods for molding the exterior impact-cushioning gripping structure 16 on the hammer illustrated and described herein because two part molding allows the tool maker to have greater control over inner layer 22 dimensions and thicknesses and over outer layer 24 dimensions and thicknesses.

The principles, preferred embodiment and modes of manufacturing the present invention have been described in the foregoing specification. However, the invention should not be construed as limited to the particular embodiments or methods which have been described above. Instead, the embodiments and methods described here should be regarded as illustrative rather than restrictive. Variations and changes may be made by others without departing from the scope of the present invention as defined by the following claims:

What is claimed is:

1. A manually operable impact tool comprising:

an elongated rigid interior handle structure extending longitudinally with respect to said impact tool;

an impact head disposed at one longitudinal end portion of said handle structure, an exterior impact cushioning gripping structure affixed to a second longitudinal end portion of said elongated interior handle structure in surrounding relation thereto, said exterior impact cushioning gripping structure comprising an inner layer of foamed material selected from a group consisting of polyvinyl chloride, polypropylene, and thermoplastic elastomer and molded in surrounding relation to said elongated interior handle structure, wherein said inner layer is molded to provide a plurality of longitudinal extending circumferentially spaced grooves on the outside surface thereof and wherein the outer layer is molded to provide a plurality of integral radially inwardly extending ribs on the inner surface thereof extending within said grooves and compatibly chemically bonded therein as aforesaid so that when a hand grips the exterior impact cushioning gripping structure, the ribs lend rigidity for the gripping load and provide a measure of control of the compression of the foamed inner layer against the handle structure, and an outer layer of solid nonfoamed material that is chemically compatible with said inner layer, said outer layer selected from said group and molded in surrounding abutting relation to said inner layer, said outer layer being constructed and arranged to provide an inner surface on the outer layer and chemically compatibly bonds to an outside surface of said inner layer and to provide an exterior surface on said outer layer configured to accommodate a manually gripping hand, the arrangement being such that when said exterior impact cushioning gripping structure is gripped by a user and the tool is manually operated to impact the tool head on a work piece, the inner layer of foamed material cushions the impact to the gripping hand of the user.

2. A manually operable impact tool as defined in claim 1 wherein the second end portion of said handle structure comprises a pair of vibration receiving elements extending longitudinally away from said one longitudinal end portion and terminating in spaced relation to one another, said vibration receiving elements defining a space therebetween and wherein said inner layer of foamed material is formed around said opposite end portion so that a portion of said inner layer is received within said space and surrounds said vibration receiving elements such that vibrations resulting when the impacting head impacts a work piece are received by said vibration receiving elements and are damped by cooperation between said elements and said inner layer of material to thereby reduce the vibrations that are transmitted to the hand of the user when said impact tool impacts a work piece.

3. A manually operable impact tool comprising:

an elongated rigid interior handle structure extending longitudinally with respect to said impact tool;

an impact head disposed at one longitudinal end portion of said handle structure, an exterior impact cushioning gripping structure affixed to a second longitudinal end portion of said elongated interior handle structure in surrounding relation thereto, said exterior impact cushioning gripping structure comprising an inner layer of foamed material selected from a group consisting of polyvinyl chloride, polypropylene, and thermoplastic elastomer and molded in surrounding relation to said elongated interior handle structure, and an outer layer of solid nonfoamed material that is chemically compatible with said inner layer, said outer layer selected from said group and molded in surrounding abutting relation to said inner layer, said outer layer being constructed and arranged to provide an inner surface on the outer layer that chemically compatibly bonds to an outside surface of said inner layer and to provide an exterior surface on said outer layer configured to accommodate a manually gripping hand, the arrangement being such that when said exterior impact cushioning gripping structure is gripped by a user and the tool is manually operated to impact the tool head on a work piece, the inner layer of foamed material cushions the impact to the gripping hand of the user, and said impact head is a hammer head.

4. A manually operable impact tool as described in claim 3, wherein said hammer head has a blunt striking surface and a nail removing claw.

5. A method for making a manually operable impact tool comprising the steps of:

providing an elongated rigid interior handle structure having a first end portion and a second end portion opposite the first end, and an impact head disposed at the first end thereof, placing the second end portion of said impact tool in a first mold cavity, filling said first mold cavity with a foamed material selected from a group consisting of polyvinyl chloride, polypropylene and thermoplastic elastomer to form an inner layer of foamed material in surrounding relation to said second end portion of said interior handle structure, said inner layer having an outer surface, placing the second end portion in a second mold cavity such that the outer surface of said inner layer is spaced from an interior surface of said second mold cavity, filling said second mold cavity with a solid, nonfoamed material that is selected from said group and that is chemically compatible with said inner layer to fill the space between said outer surface of said inner foamed layer to form an outer layer of solid, nonfoamed material bonded to the outer surface of said inner layer, said outer layer having an exterior surface that is configured to accommodate gripping by a hand, and the providing an impact head disposed at the first end thereof includes providing an impact head formed as a hammer head.

6. A method as described in claim 5, wherein said providing an impact head disposed at the first end thereof includes providing an impact head formed as a hammer head having a blunt striking surface and a nail removing claw.

* * * * *